United States Patent [19]

Guarlotti et al.

[11] Patent Number: 4,848,365

[45] Date of Patent: Jul. 18, 1989

[54] METHOD OF IN-SITU CUSTOM FITTING A PROTECTIVE MOUTHGUARD

[76] Inventors: Clement A. Guarlotti, R.D. #2, Caldwell Dr., Jeannette, Pa. 15644; Daniel J. Rinchuse, 13 Forest Ave.; Donald J. Rinchuse, 944 Harvey Ave., both of Greensburg, Pa. 15601

[21] Appl. No.: 19,436

[22] Filed: Feb. 26, 1987

[51] Int. Cl.[4] ..... A61F 5/56

[52] U.S. Cl. ..... 128/859; 128/861; 128/862

[58] Field of Search ..... 128/136, 132, 859, 861, 128/862; 433/6

[56] References Cited

U.S. PATENT DOCUMENTS

| | | | |
|---|---|---|---|
| 2,643,652 | 6/1953 | Cathcart | 128/136 |
| 2,750,941 | 6/1956 | Cathcart | 128/136 |
| 3,107,668 | 10/1963 | Thompson | 128/136 |
| 3,124,129 | 3/1964 | Grossberg | 128/136 |
| 3,314,423 | 4/1967 | Boatwright | 128/136 |
| 3,407,808 | 10/1968 | Baldwin | 128/136 |
| 3,411,501 | 11/1968 | Greenberg | 128/136 |
| 3,485,242 | 12/1969 | Greenberg | 128/136 |
| 3,692,025 | 9/1972 | Greenberg | 128/136 |
| 3,871,370 | 3/1975 | McDonald | 128/136 |
| 4,270,531 | 6/1981 | Blachly et al. | 128/136 |
| 4,672,959 | 6/1987 | May et al. | 128/136 |

*Primary Examiner*—Robert A. Hafer
*Assistant Examiner*—Kevin G. Rooney
*Attorney, Agent, or Firm*—Harry B. Keck

[57] ABSTRACT

An improved protective mouthguard blank is adapted for in situ custom-fitting by an athlete/patient. A method for in situ custom-fitting is disclosed. The resulting in situ custom-fitted mouthpiece provides superior retention and protective characteristics. The protective mouthguard blank has a generally V-shaped channel corresponding to a normal dental arch and is formed from thermoplastic substances which have a softening, moldable temperature in the range of 120–160 degrees F. The protective mouthguard blank has outer side walls which are longer than the labial vestibule and the buccal vestivules of the athlete/patient. The resulting in situ custom-formed protective mouthguard consequently has an outer side wall which substantially entirely fills the athlete/patient's buccal vestibules and labial vestibule.

1 Claim, 4 Drawing Sheets

METHOD OF IN-SITU CUSTOM FITTING A PROTECTIVE MOUTHGUARD

BACKGROUND OF THE INVENTION

1. Field of the Invention

This invention concerns mouthguards intended to be worn by athletes and other persons engaged in physical activities which might result in occlusal or craniofacial stress and more particularly concerns a method for fitting a protective mouthguard blank adapted to be custom fitted in-situ to an individual athlete/patient.

2. Description of the Prior Art

Athletes and particularly football players, boxers and basketball players, are exposed to trauma from facial blows which may cause damage to the individual. To reduce the hazards of such facial trauma injuries, a variety of protective mouthguards have been developed for use by athletes and others. Medical and dental patients occasionally require protective mouthguards. These prior art protective mouthguards for athletes/patients can be defined in several categories. The designation "athlete/patient" herein is intended to identify any user of the invention.

First category: There is a universal protective mouthguard, to be worn as received without any adaptation to an individual user. These First category protective mouthguards are shaped from rubber or other plastic material and which conforms generally to the configuration of an average upper dental arch and includes a channel having a base, an inner wall and an outer wall. Such universal protective mouthguards tend to fit loosely and function primarily to distribute the physical stresses from a facial blow over a wide area. Such universal protective mouthguards are not easily retained by the athlete/patient and are frequently dislodged as a result of the blow or blows which they were intended to resist.

Second category: There are custom cast-fitted, molded devices, prepared for each individual athlete/patient by initially obtaining an impression of the athlete/patient's dental arch and upper teeth and preparing from the impression a plaster (sometimes called "stone") cast corresponding to the individual athlete/patient's dental arch and upper teeth. The protective mouthguard is molded from rubber or plastic against the plaster (stone) cast and thereafter is introduced into the athlete/patient's mouth where it achieves good retentive characteristics and provides superior dental protection. The expense and time requirement for such custom fitted, molded protective mouthguards is substantial, requiring services of skilled dental personnels.

Third category: There are universal blanks, much like the universal mouthguard of the First category, which are fabricated from post-formable, thermoplastic substances which can be molded and shaped, when needed, by the athlete/patient or by skilled dental personnel to conform more accurately to the athlete/patient's dental arch. The universal blanks for these in-situ custom-fitted mouthguards comprise a generally U-shaped channel having a base, an inner wall and an outer wall. The loose-fitting universal blank is heated to soften the thermoplastic blank, while warm, is fitted against the teeth of the athlete/patient by the athlete/patient or by skilled dental personnel. The resulting in-situ custom-fitted protective mouthguard has good retention characteristics but has a number of shortcomings:

1. The overall configuration of the prior art universal formable blank is a U-shape, whereas the normal dental arch is more of a V-shape;

2. The universal formable blank has a coplaner base from which an outer wall and an inner wall are extended generally vertically. The maxillary incisor inclination of an athlete/patient is not generally vertical to the athlete/patient's occlusal plane but instead rises at an acute angle with respect to the occlusal plane. Substantial compressive movement of the thermoplastic outer wall of Third category mouthguards is required to conform with the athlete/patient's incisors.

Similarly the lingual maxillary incisor surface of an athlete/patient is not perpendicular to the athlete/patient's occlusal plane but rises at an acute angle with respect to the occlusal plane. Conformation of the thermoplastic inner wall of Third category mouthguards also requires compressive movement of the inner wall.

The vertical walls of the Third category mouthguards terminate at the level of the dental-gingival interface and the outer vertical walls also terminate at the dental-gingival interface.

The in-situ custom-forming of Third category mouthguards occurs by inwardly applied pressures, that is, pressures applied against the athlete/patient's teeth on the lingual surface and the buccal and labial surfaces of the teeth result in a compression of the formable thermoplastic substance against the teeth and against the relatively resilient gingival surfaces. Upon relaxation of the compressive forming pressures, the thermoplastic substance tends to spring back away from the teeth and resilient gingival surfaces.

One embodiment of protective mouthguards for athlete/patients in all three categories includes a contiguous strap extending forwardly from the incisor portion of the mouthguard base. The strap is intended to be fastened to a helmet faceguard so that the protective mouthguard will not be lost when the athlete/patient removes the protective mouthguard for comfort, for convenience, or when the mouthguard is displaced involuntarily upon impact. Such strap connections can be dangerous if the athlete/patient's helmet is removed while a securely-retained protective mouthguard remains in place. The hazard increases as the retention characteristics of the protective mouthguard are improved. The prior art straps have not been reliable in their release tension.

STATEMENT OF THE PRESENT INVENTION

According to the present invention, a novel thermoplastic blank of the Third category is provided for custom fitting a protective mouthguard. The blank is fabricated from thermoplastic materials which become malleable and readily formable at temperatures in the range of about 120 degrees to 160 degrees F. The blank has a novel configuration which is unlike any prior art blank. Specifically, the blank has a generally V-shaped configuration which corresponds more nearly to the general dental arch configuration moreso than the U-shaped configuration of the prior art universal blanks. Overall the new blank is generally V-shape which receives upper teeth and has a channel-member base (occlusal) surface and having an outer (buccal and labial) wall and an inner (lingual) wall. The labial surface portion of the outer wall is presented at an acute angle with respect to the base (occlusal) surface. The lingual surface of the inner wall rises at an obtuse angle with respect to the base (occlusal) surface in the region of the incisors and nearly vertically in the molar regions.

The outer wall extends above the base (occlusal) surface for a distance which is greater than the buccal vestibule length and greater than the labial vestibule length of the athlete/patient. The central region of the labial surface of the outer wall is notched to accomodate the athlete/patient's labial frenum.

In one preferred embodiment, the anterior portions of the inner walls are connected by a sheet made from the same formable thermoplastic substance to provide a palate-engaging surface in the resulting mouthguard.

In a further embodiment, the blank is provided with a convex inwardly extended bead on the outer wall confronting the buccal and labial dental-gingival interface. In a still further embodiment, the blank is provided with a convex bead on the inner wall confronting the lingual surfaces in the region of the dental-gingival interface.

The blank is custom fitted in-situ for an athlete/patient by heating the blank and inserting the heated blank into the athlete/patient's mouth. The athlete/patient bites into the base which deforms into conformation with the athlete/patient's teeth and mucosal tissue. The athlete/patient then withdraws air from his mouth causing the inner wall to conform to the lingual surfaces of the teeth and the lingual gingival tissue surfaces. The athlete/patient massages the inner surface with his tongue to achieve a tight engagement of the thermoplastic substance against the teeth and lingual gingival-mucosal surfaces. The athlete/patient moves his lips repeatedly downwardly, upwardly and from side-to-side in stretching movements to cause the thermoplastic substance in the buccal vestibules and in the labial vestibule to conform to the normal shape of the buccal vestibules and labial vestibule so that the resulting in-situ custom-fitted protective mouthguard substantially entirely fills both buccal vestibules and the labial vestibule of the athlete/patient.

The athlete/patient's teeth and gums cause outward movement of the thermoplastic substance away from the teeth, i.e., stretching the thermoplastic substance, during the forming operation—as distinguished from the inward compression movement of the thermoplastic material of prior art in-situ custom-fitted protective mouthguards.

In a preferred embodiment, a palate-engaging sheet of thermoplastic conforms with the athlete/patient's anterior palate as a result of pressures applied by the athlete/patient's tongue. The resulting palate surface provides greatly improved suction-type retention for the resulting protective mouthguard. The fitting is essentially completed by the athlete/patient himself.

In a further embodiment, a connecting strap is secured to the custom post-fitted mouthguard as a forward extension from the mouthguard base and is retained by a quick release, low tension threshold connector which will separate the strap into two pieces at a low tensile stress, preferably from about three to five pounds. A preferred quick release, low tensile stess threshold connector is a pressfit tongue and socket connector.

The principal object of the invention is to provide an improved universal protective mouthguard blank fabricated from thermoplastic materials which can be in-situ custom—fitted in an athlete/patient's mouth principally by an athlete/patient himself to conform to the athlete/patient's teeth and to substantially entirely fill the athlete/patient's buccal vestibules and labial vestibule whereby superior protection and retention are achieved without requiring highly skilled dental personnel.

A further object of the invention is to provide an in-situ custom-fitted protective mouthguard blank comprising a generally V-shaped channel having an outer wall presented at an acute angle to the base and having an inner wall presented at an obtuse angle to the base.

A still further object of the invention is to provide a formable thermoplastic protective mouthguard blank having a surface of thermoplastic substance covering the anterior palate portion of the blank between the inner walls.

A further object of the invention is to provide a formable protective mouthguard blank having a convex bead on the tooth-confronting surface of the outer wall and a convex bead on the tooth-confronting surface of the inner wall in the region of the dental-gingival interface.

A further object of the invention is to provide an in-situ custom-fitted protective mouthguard which can be fitted by the athlete/patient himself and which includes outer walls substantially entirely filling the athlete/patient's buccal vestibules and labial vestibule and having a palate-engaging anterior sheet for improving the retention and ease of custom fitting. The palate engaging sheet provides wearer-comfort for the athlete/patient when compared with prior art in-situ custom-fitted protective mouthguards by precluding penetration of the athlete/patient's tongue-tip between the mouthguard and the palate—expecially during swallowing.

A further object is to provide a method for custom fitting an improved protective mouthguard from a mouthguard blank.

Another object is to provide a retaining strap for a protective mouthguard comprising a forwardly presented strap having a low-tension threshhold release device.

DESCRIPTION OF THE PREFERRED EMBODIMENTS

According to the present invention, a protective mouthguard blank is provided which is manufactured from a thermoplastic substance which become softened, malleable and easily moldable at temperatures in the range of 120–160 degrees F. and which is hardened and not malleable at temperatures below 110 degrees F. Typical plastic substances include various ethylene/vinyl acetate co-polymers and blends of ethylene/vinyl acetate co-polymers which are customarily employed in dental prosthetic devices. Thermoplastic acrylics and blends of acrylics with other thermoplastic substances also are useful. The thermoplastic substance, in its malleable state should have a consistency of chewing gum.

Figure 9:
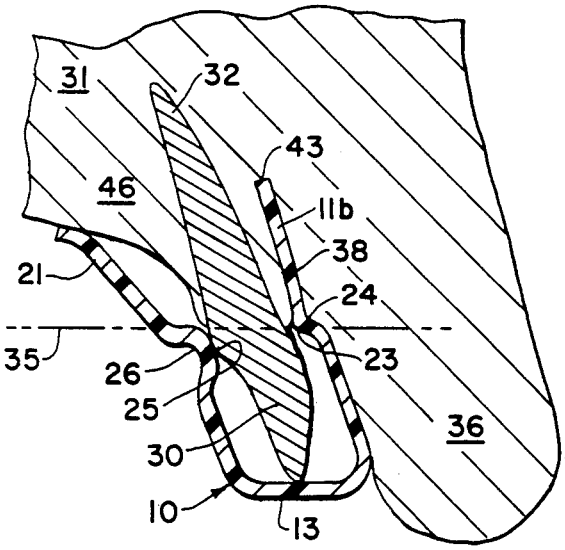
FIGS. 9 and 10 are cross-section illustrations, similar to FIGS. 7 and 8 respectively, illustrating the initial application of the protective mouthguard blank of FIG. 1.
Figure 10:
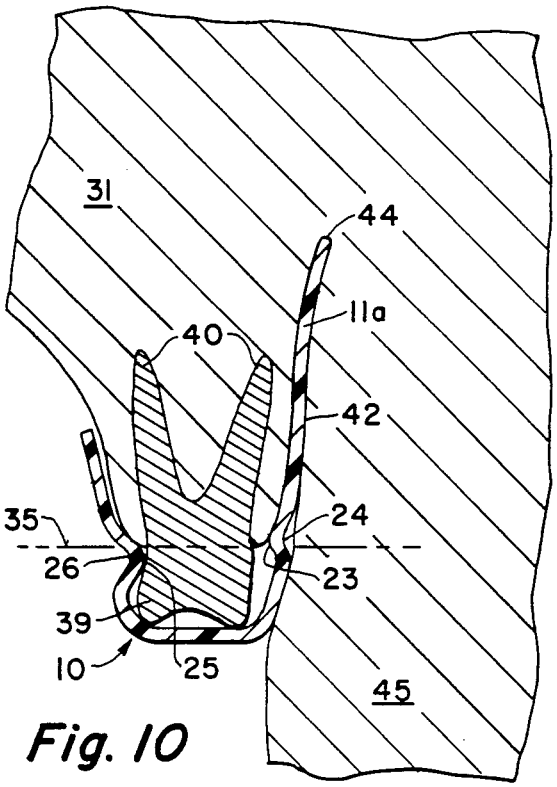

The present invention employs a protective mouthguard blank 10 which is illustrated in FIGS. 1 through 6 inclusive and in FIGS. 9, 10.

Figure 1:
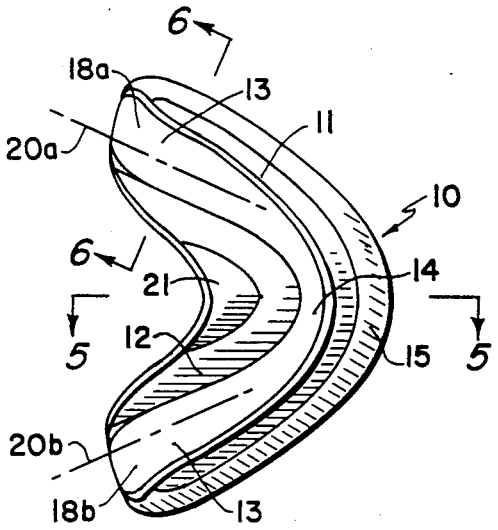
FIG. 1 is a plan view of a protective mouthguard blank according to this invention.
Figure 2:
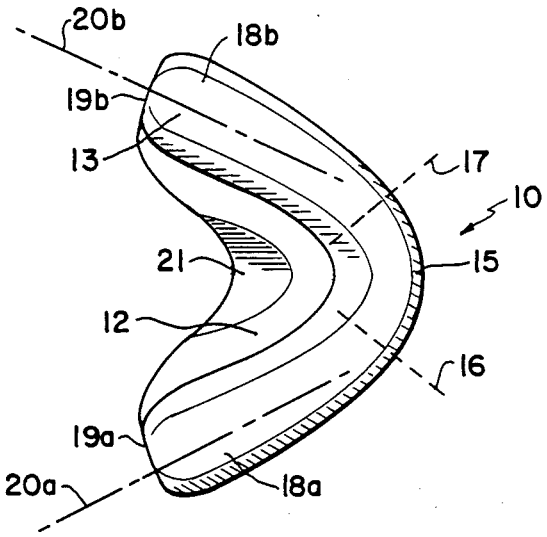
FIG. 2 is a bottom view of the protective mouthguard blank of FIG. 1.
Figure 3:
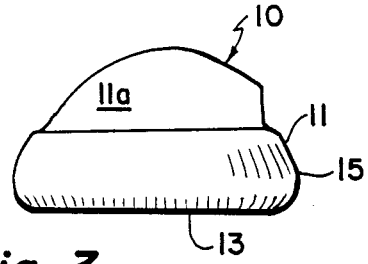
FIG. 3 is a side elevation view of the protective mouthguard blank of FIG. 1.
Figure 4:
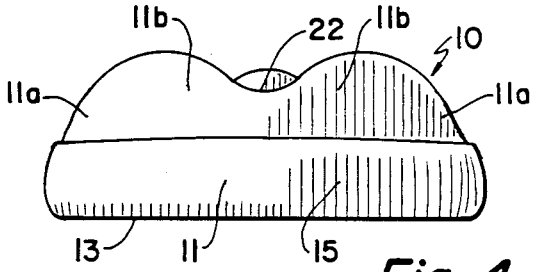
FIG. 4 is a front elevation view of the protective mouthguard blank of FIG. 1.
Figure 5:
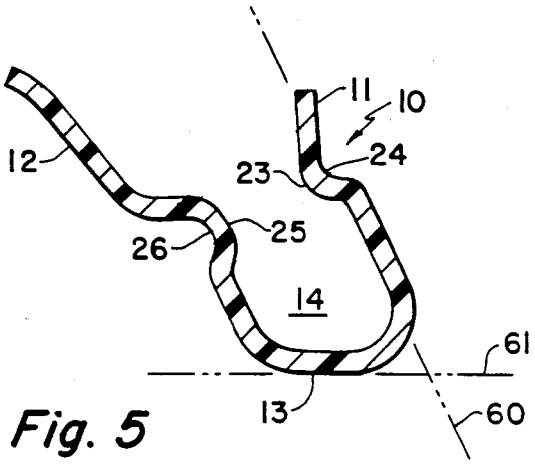
FIG. 5 is a cross-section view of the protective mouthguard blank of FIG. 1 taken along the line 5—5.
Figure 6:
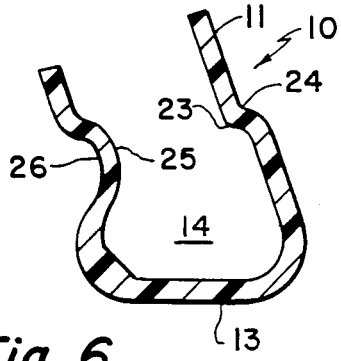
FIG. 6 is a cross-section view of the protective mouthguard blank of FIG. 1 taken along the line 6—6.

The blank 10 includes an outer wall 11, an inner wall 12 and a base 13 which define a generally V-shaped channel 14 (most clearly seen in FIGS. 5, 6). The channel 14 includes an incisal region 15 which is positioned between broken lines 16, 17 and includes two occlusal regions 18*a*, 18*b* extending from the broken lines 16, 17 respectively, toward posterior ends 19*a*, 19*b* respectively of the blank 10. The V-shaped configuration of channel 14 can be appreciated by observing the central longitudinal axes of the channel 14 in the occlusal regions 18*a*, 18*b* as indicated by the broken lines 20*a*, 20*b* which converge at an angle of about 35 to 50 degrees. A curved sheet 21 of the thermoplastic substance extends from the inner walls 12 and corresponds to the anterior portion of the athlete/patient's palate. The outer wall 11 extends upwardly in the occlusal regions 18*a*, 18*b* as shown at 11*a* and extends upwardly in the incisal region 15 as shown at 11*b*. The upward extension 11*a* is intended to substantially entirely fill the athlete/patient's buccal vestibules as shown more clearly in FIG. 10. The outer wall 11*b* is intended to substantially entirely fill the athlete/patient's labial vestibule as shown in FIG. 9. The upward extension 11*b* has a central notch 22 which accommodates the labial frenum of the athlete/patient.

Figure 7:
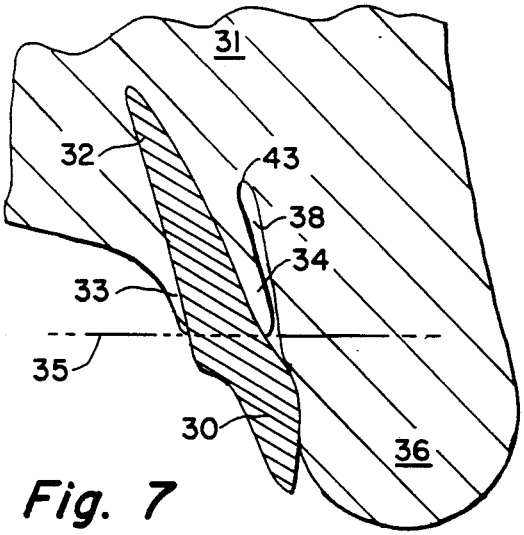
FIG. 7 is a schematic cross-section illustration of a typical upper jaw, front incisor and contiguous upper lip of an athlete/patient.
Figure 8:
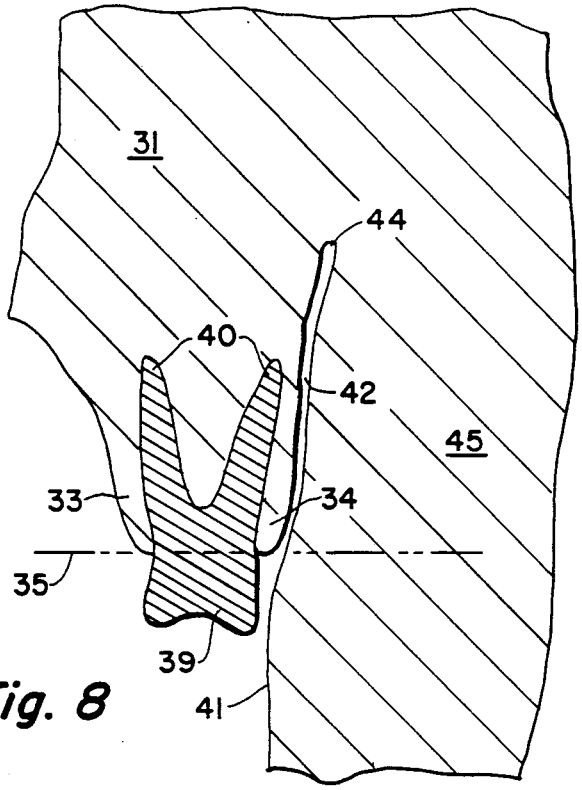
FIG. 8 is a schematic cross-section illustration of a typical upper jaw, molar and contiguous cheek of an athlete/patient.

Anatomy and nomenclature of the upper jaw region will be set forth in relation to FIGS. 7 and 8. In FIG. 7, an incisor 30 depends from a jaw 31 in which a dental root 32 is embedded and covered by gingival tissue 33, 34. A dental-gingival interface is indicated by a broken line 35. An upper lip 36 has its inner surface 37 generally resting against the incisor 30 and contiguous gingival tissue 34 presenting a labial vestibule 38 which extends above the gingival dental interface for a substantial distance.

In the occlusal region shown in FIG. 8, the upper jaw 31 retains molars 39 having roots 40 embedded in gingival tissue 33, 34. The athlete/patient's cheek 45 has in inner surface 41 which confronts the outer gingival tissue 34 and forms a buccal vestibule 42 which extends above the gingival dental interface.

One of the objectives of the present invention is to provide a protective mouthguard blank which has outer walls 11 which substantially entirely fill the labial vestibule 38 and the buccal vestibules 42. In a preferred embodiment, the outer wall 11 extends above the upper fold 43 of the labial vestibule 38 and above the upper fold 44 of the buccal vestibules 42 thereby causing some distortion of the tissues in the regions of the folds 43, 44 when the protective mouthguard blank 10 is initially inserted into the athlete/patient's mouth for post-fitting.

The protective mouthguard blank 10 has an inwardly convex bead 23 in a preferred embodiment, extending over the outer wall 11 of the blank 10 and has a corresponding inwardly presented groove 24. The convex bead 23 engages the athlete/patient's jaw in the region of the dental-gingival interface indicated by the dotted line 35 in FIGS. 7–10, inclusive.

A similar convex groove 25 and corresponding bead 26 is presented over the inner wall 12. The convex groove 25 engages the lingual dental-gingival interface. The convex beads 23, 25 are intended to engage the athlete/patient's gingival-dental interface in a pincers-like grip.

FIGS. 9 and 10 illustrate the initial application of the protective mouthguard blank 10 to the athlete/patient's mouth anatomy. Referring to FIG. 9, the sheet 21 engages the athlete/patient's palate 46; the convex bead 25 engages the lingual dental-gingival interface; the convex bead 23 engages the labial (FIG. 9) and buccal (FIG. 10) dental-gingival interface. The outer wall 11*a* substantially entirely fills the buccal cavity 42 and, in a preferred embodiment, stretches the buccal vestibule fold 44. Similarly the outer wall portion 11*b* substantially entirely fills the labial vestibule 38 and stretches the labial vestibule fold 43. The occlusal surfaces of the molars 39 and the incisal surfaces of the incisors 30 engage the base 13 of the blank 10.

In a preferred in-situ custom-fitting sequence, the blank 10 will be initially inserted in the athlete/patient's mouth to determine if the proper size blank has been selected. The invention contemplates several sizes of blank, e.g., small, medium, large. The proper size blank 10 will have a V-shape approximating that of the athlete/patient and will have its upper outer surfaces 11*a*, 11*b* substantially entirely filling the labial vestibule 42 and buccal vestibules 38, respectively. Thereafter the blank 10 is withdrawn and heated to a molding temperature preferably from 120 to 160 degrees F. and reinserted into the athlete/patient's mouth.

One of the advantages of the present in-situ custom-fitted protective mouthguard blanks is that the athlete/patient can achieve most of the in-situ custom-fitting through normal physiologic anatomy movements as follows. The athlete/patient withdraws air from his mouth and concurrently presses his tongue against the sheet 21 pressing the thermoplastic substance into engagement with the palate 46 and pressing the tongue against the lingual surface of the inner wall 12. The athlete/patient also bites against the base 13 so that the tooth surfaces engage and deform the moldable base 13. The athlete/patient also moves his lips from side-to-side and up-and-down causing the outer wall 11 to engage the labial and buccal surfaces of the teeth and causing the upper portions 11*a*, 11*b* of the outer wall to conform with the normal configuration of the labial vestibule 38 and the buccal vestibules 42, respectively.

Figure 11:
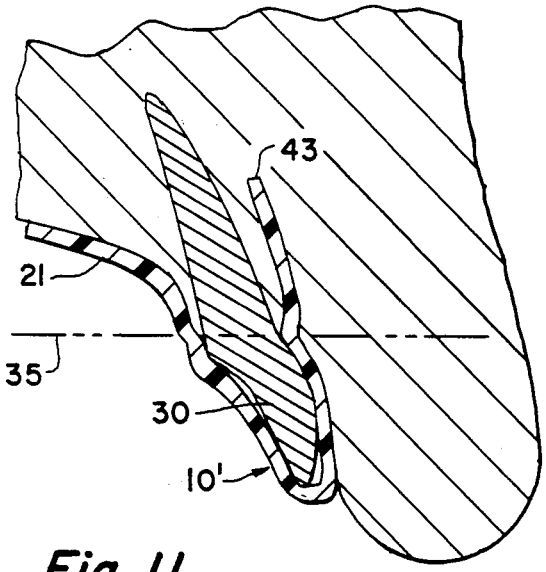
FIGS. 11 and 12 are cross-section illustrations, similar to FIGS. 7 and 8 respectively, showing the final post-fitted protective mouthguard formed from the protective mouthguard blank of FIGS. 9, 10, respectively.
Figure 12:
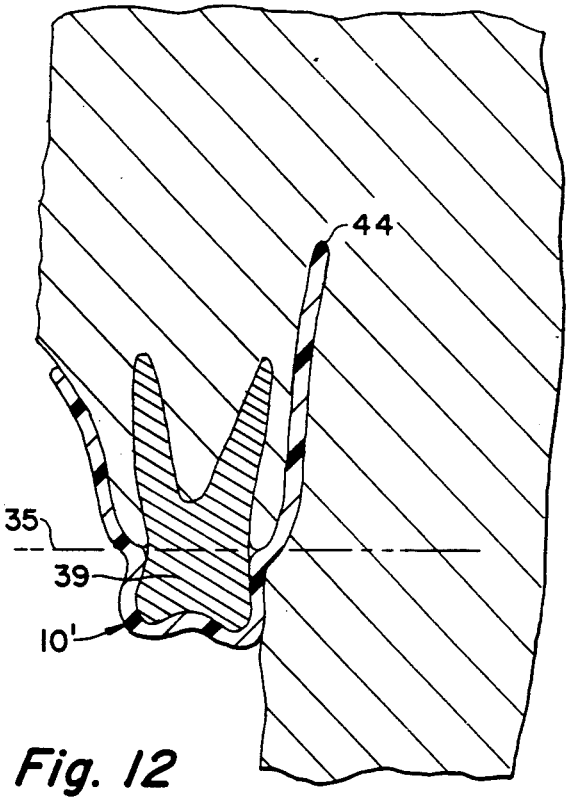
Figure 14:
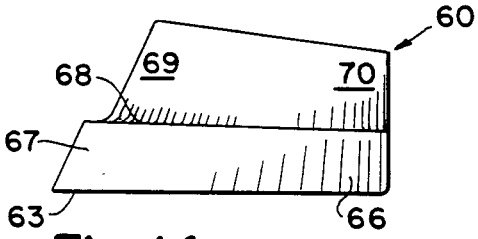
FIGS. 13, 14, 15 and 16 are a front elevation, a side elevation, a plan view and a bottom view, respectively, of a mold which may be employed to form the protective mouthguard blank of FIG. 1.
Figure 13:
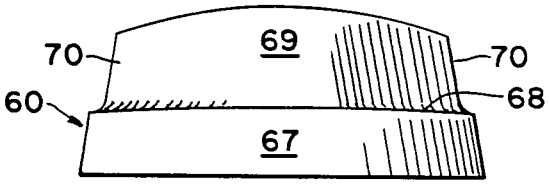
Figure 15:
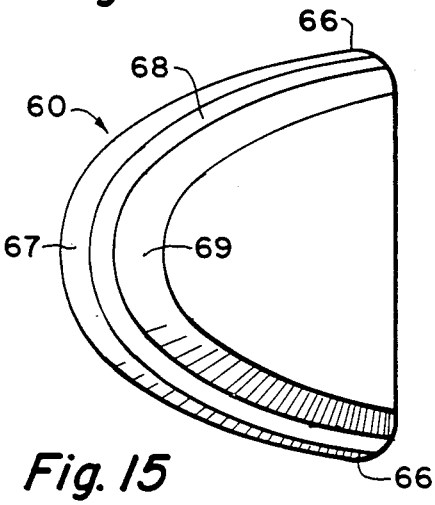
Figure 16:
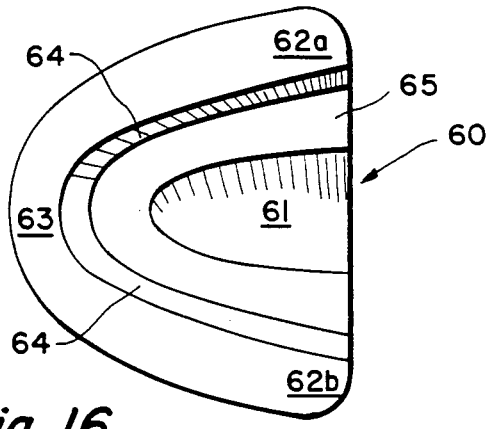

The resulting in-situ custom-fitted protective mouthguard is illustrated in FIGS. 11 and 12 showing conformation of the device to the dental surfaces, the gingival surface and substantially entirely filling the labial vestibule and a buccal vestibule to provide superior jaw and tooth protection and to provide superior retention characteristics for the protective mouthguard. In addition, a preferred embodiment including the surface 21, provides conforming engagement with the anterior portion of the athlete/patient's palate 46 to create a suction seal providing added retention of the protective mouthguard in its operative position.

After the in-situ custom-fitted mouthguard has cooled below its moldable temperature, the thermoplastic substance becomes firm and the protective post-fitted mouthguard uniquely fits the athlete/patient and provides superior protection to the jaw and teeth with superior retention characteristics.

Figure 18:
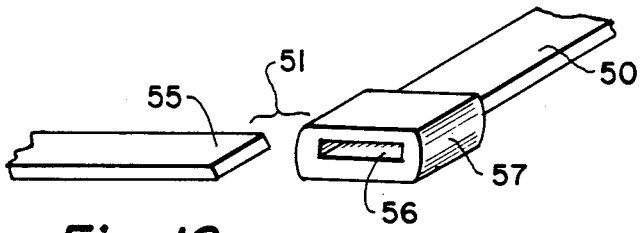
FIG. 18 is a perspective illustration of one example of a low tension disconnect device for use with the retaining strap of FIG. 17.
Figure 17:
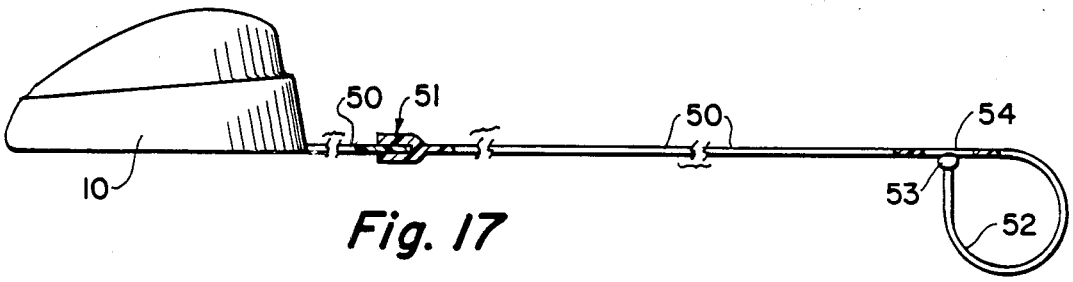
FIG. 17 is a schematic illustration of a protective mouthguard blank having a retaining strap with a low tension disconnect device.

As shown in FIG. 17, the post-fitted athletic protective mouthguard 10' has a forwardly extending strap 50 which extends between the athlete/patient's lips and contains an intermediate portion having a low tension disconnect device 51 and a remote portion having an easily mounted anchor device 52, for example, a sphere 53 which can be inserted through a central slot 54 to retain the strap on a protective helmet face guard. The low tension disconnect device 51 may include a tongue and socket, pressfit device as shown in FIG. 18 including a generally rectangular tongue 55 and a close fitting generally rectangular cross-section socket 56 recessed in a small handle 57 connected to an additional length of the strap 50. The low tension disconnect device 51 is intended to release at a low tensile threshold, for example, three to five pounds tension, so that the fastening strap 50 will be separated if the athlete/patient's helmet is unintentionally removed from the athlete/patient's head. A low tension disconnect device is particularly important with the present protective mouthguard which has superior retention characteristics.

One of the features of the present protective mouthguard blank and the resulting protective post-fitted mouthguard is a recognition that the normal inclination of incisors and of the labial vestibule is not generally perpendicular to the occlusal plane but instead is rearwardly tapered at an acute angle to the occlusal plane. The angle is approximately 60 to 75 degrees as can be seen from the broken lines 60, 61 of FIG. 5 wherein broken line 60 corresponds to the incisor taper and the broken line 61 coincides with the occlusal plane.

Molds—The present protective mouthguard blanks preferably are made from standard molds in about two to four standard sizes to accomodate various mouth sizes from children to large adults. FIGS. 13–16 inclusive illustrate a typical mold which includes the following features:

- a palatal surface 61;
- two occlusal surfaces 62*a*, 62*b;*
- an incisor surface 63;
- a lingual surface 64 and a concave groove 65 which defines the convex bead 23;
- a buccal surface 66 (one each side);
- a lingual surface 67;
- a shoulder or bench 68;
- a labial vestibule surface 69 and two buccal vestibule surfaces 70.

Examination of the mold of FIGS. 13 through 16, inclusive, will indicate the acute angle of the labial surface 67 relative to the incisal surface 63. The molds 60 further indicate the upward extension of the labial vestibule and buccal vestibule surfaces of the outer wall of the protective mouthguard blank.

In another preferred embodiment, the upper portions of the outer walls 11 are formed from a thermoplastic substance which is more malleable than the lower portions of the outer wall to facilitate the in-situ custom-fitting.

We claim:

1. The method of in-situ custom-fitting a protective mouthguard blank comprising:

providing a mouthguard blank which is formed such that the outer wall is higher than the athlete/-patient's buccal vestibules and labial vestibule:

heating the blank to a softening, molding temperature from 120 to 160 degrees F. and inserting the heated blank form into the athlete/patient's mouth;

compressing the said blank form against the athlete/-patient's upper teeth until the thermoplastic substance in the base conforms to said upper teeth;

molding the said outer wall downwardly and inwardly against the athlete/patient's teeth and outer gingival surface until the said outer wall conforms with the athlete/patient's buccal vestibules and labial vestibule;

conforming the said inner wall with the inner surfaces of the athlete/patient's teeth and lingual tissue surfaces by creating a suction in the athlete/patient's mouth and concurrently pressing the athlete/-patient's tongue over the said inner wall against the inner teeth surfaces and the lingual tissue surface;

thereafter, removing excess plastic substance, if necessary, until the said protective mouthpiece fits comfortably and firmly in the athlete/patient's mouth, and substantially entirely fills the buccal vestibules and the labial vestibule.

* * * * *